US005099896A

United States Patent [19]

Ritola

[11] Patent Number: 5,099,896

[45] Date of Patent: Mar. 31, 1992

[54] ROTARY BOARD PICK/STORE/PLACE METHOD AND APPARATUS

[75] Inventor: Edward Ritola, La Center, Wash.

[73] Assignee: Harvey Industries, Inc, Little Rock, Ak.

[21] Appl. No.: 690,296

[22] Filed: Apr. 24, 1991

[51] Int. Cl.[5] ..... B27B 1/00

[52] U.S. Cl. ..... 144/357; 83/365; 83/370; 144/2 R; 144/242 R; 144/245 R; 144/245 A; 144/379; 198/347.2; 414/788.8

[58] Field of Search ..... 250/563; 144/356, 357, 144/2 R, 242 R, 245 R, 245 A, 245 B, 379; 198/347.2, 347.3; 414/788.8; 83/365, 367, 370

[56] References Cited

U.S. PATENT DOCUMENTS

| | | | |
|---|---|---|---|
| 3,122,229 | 2/1964 | Engleson et al. | 198/347 |
| 3,363,520 | 1/1968 | Obenshain . | |
| 3,782,523 | 1/1974 | Giatti | 198/347.2 |
| 4,207,472 | 6/1980 | Idelsohn et al. | 144/357 X |
| 4,399,849 | 8/1983 | Nowakowski . | |
| 4,560,057 | 4/1985 | Applegate . | |
| 4,585,113 | 4/1986 | Greenwell . | |
| 4,711,336 | 12/1987 | Mattel . | |
| 4,865,094 | 9/1989 | Stroud et al. . | |
| 4,887,219 | 12/1989 | Strauser . | |
| 4,947,909 | 8/1990 | Stroud . | |

FOREIGN PATENT DOCUMENTS 2195311 4/1988 United Kingdom .

*Primary Examiner*—W. Donald Bray

*Attorney, Agent, or Firm*—Kolisch, Hartwell, Dickinson, McCormack & Heuser

[57] ABSTRACT

Apparatus for loading or picking, temporarily storing and placing one of two side-by-side cut boards from/to a lugged conveyor is described. The apparatus preferably includes a circulating wheel oriented transversely to the lugged conveyor with the wheel having a number of arcuately spaced bins, each capable of temporarily storing a cut board, or board piece, of any crosscut length. The wheel is rotated such that its angular velocity tangent to the lugged conveyor is approximately equal to the linear velocity of the lugged conveyor. The number of bins provided in the wheel is determined by the number of boards that will have been already loaded onto the conveyor at the loading station before the pick operation can be temporarily halted by a decision of the board scanner that a cut-in-two operation will be performed. Responsive to such a signal, which is delayed in time due to the distance between the pick station and the scanning station and due to the time required for the scanner to make such a decision, the loading station skips a pick cycle, thereby producing an empty space on the lugged conveyor for the extra board piece.

13 Claims, 4 Drawing Sheets

ROTARY BOARD PICK/STORE/PLACE METHOD AND APPARATUS

BACKGROUND OF THE INVENTION

This invention relates generally to board handling equipment. More particularly, the invention concerns apparatus disposed downstream from a board scanning/crosscutting station that provides selectively for the picking and temporary storage of one of two board pieces produced by a crosscutting operation and suitable for further downstream processing for a period of time equal to the positional and decisional delays inherent in the board scanning operation, thereby permitting the placement of one of the cut-in-two board pieces in a free or empty lug space located upstream of the location from which the board piece was deflected.

It is desirable to operate a board scanning/crosscutting system at high speed and preferably continuously for maximum throughput. Conventional board scanning equipment can profile a board and produce control signals to a crosscutting station to activate one or more saws, thereby automatically to produce an optimum yield from the board. Most often, one or more pieces resulting from such a crosscutting operation are unsuitable for further downstream lumber processing because they are undersized, knotty, damaged, warped or otherwise defective. Such unsuitable pieces are diverted from mainstream board processing into bins or onto separate conveyors for chipping, pulping or scrapping. At other times, a raw board is cut in two in such an operation and it can be seen that both pieces resulting from the cutting operation are suitable for downstream processing, i.e. both pieces are keepers. In this latter case, it is desirable to continue the advancement of both pieces downstream on the same conveyor.

The problem is that such board scanning/crosscutting systems, as well as downstream board processing stations such as sorters, ripping trimmers and edgers must handle individual boards that are generally equally spaced from one another. Typically, this is accomplished by the use of lugged conveyors having discrete board-accommodating locations. Accordingly, when a raw board that is being advanced downstream on such a lugged conveyor is cut into two pieces, means must be provided for downstream handling of an extra board piece for which there is no such board space allocated on the lugged conveyor. Conventionally, board scanning/crosscutting systems have avoided the problem by treating all but a single piece of lumber yielded from the crosscutting operation as scrap, resulting in a volume of waste at great cost.

SUMMARY OF THE INVENTION

Accordingly, it is a principal object of the present invention to provide a higher-yield solution to the cut-in-two board handling problem.

More specifically, it is an object of the invention to provide means for temporarily storing a selected one of two cut board pieces until an empty lug space on the conveyor can be created to accommodate it and means for depositing the stored board piece in such empty space.

It is another object of the invention to provide a solution to the extra board handling problem with minimal adverse impact on system throughput.

Yet another object is to provide such a solution that can be readily and cost effectively retrofitted into existing lumber handling installations.

The apparatus of the invention in its preferred embodiment takes the form of a rotary, plural bin circulating wheel driven in synchronization with the a lugged conveyor that advances the boards continuously through the picking/scanning/crosscutting stations. The number of bins in the circulating wheel is equal to the number of lug locations on the conveyor that will have been loaded with boards before an empty space can be created. Such an empty space is created by control of the board pick station by the board scanner, based upon the latter's decision to cut a board in two. Because the apparatus is in the form of a rotary circulating wheel, it requires a minimal amount of floor space and most often can be retrofitted into existing systems with negligible impact on the site floor plan. Thus the solution makes possible more efficient raw board use, has no adverse impact on system speed and is cost effective.

DETAILED DESCRIPTION OF THE PREFERRED EMBODIMENT

Figure 1:
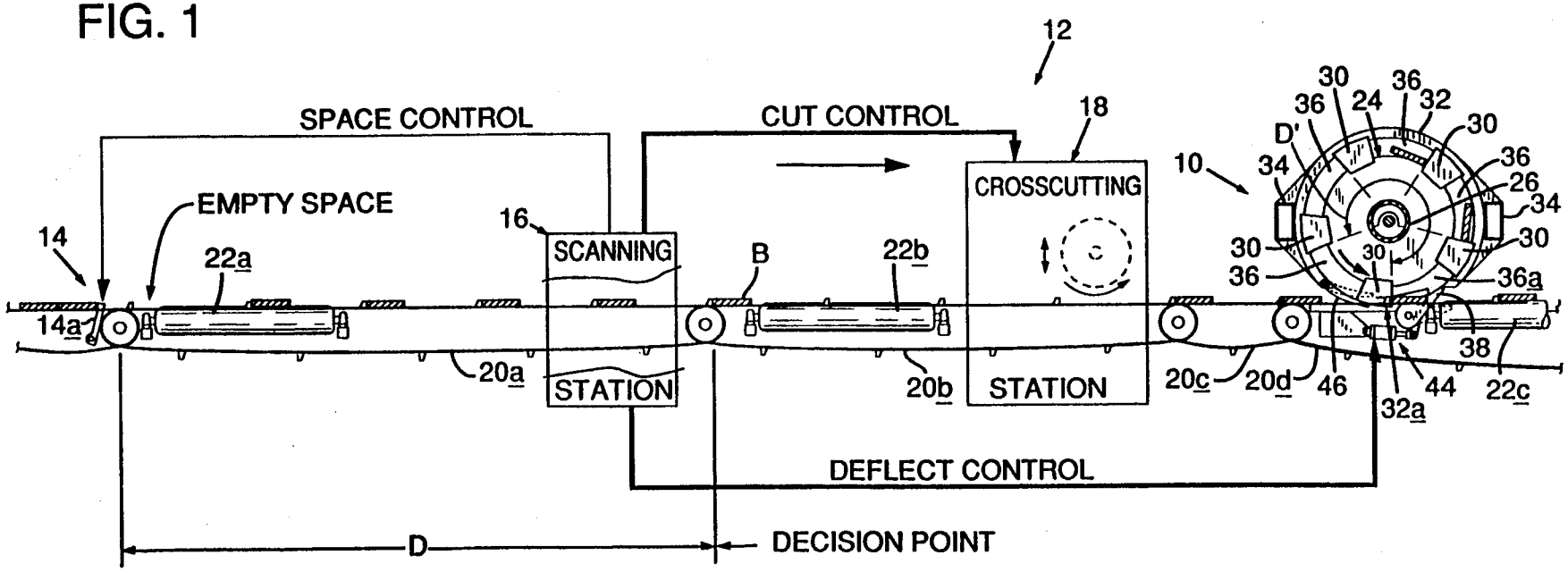
FIG. 1 shows schematically a front elevation of the invention as forming a part of a larger system.
Figure 2:
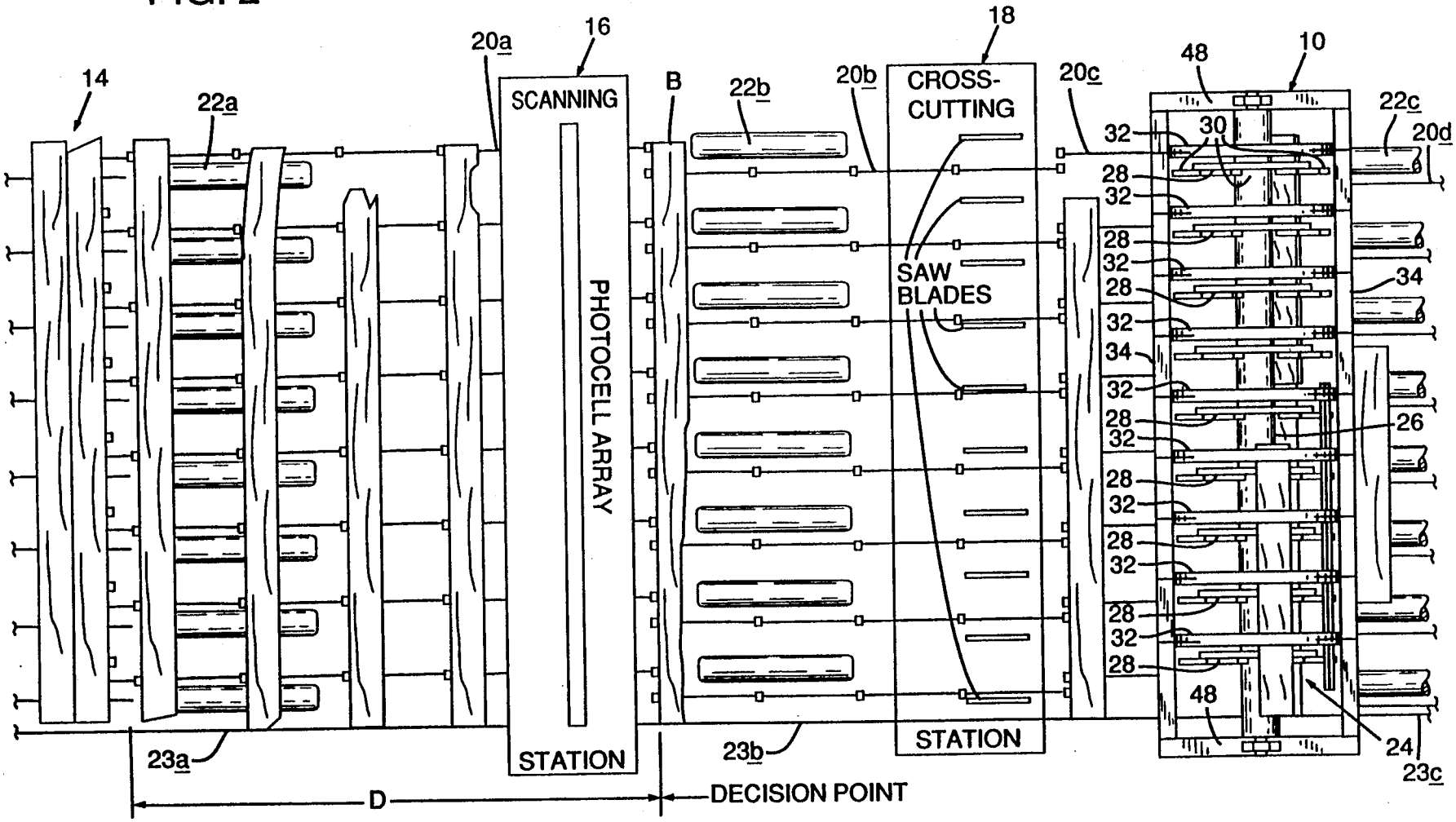
FIG. 2 shows schematically a top plan view corresponding with FIG. 1.

Referring collectively to FIGS. 1 and 2, the apparatus of the invention is indicated generally at 10, and can be seen to be of use with a lumber handling system 12 shown (schematically, in part) in front elevation and top plan view. System 12 typically includes a board pick station, or lugged loader, 14; an optimizing board scanning station 16; a crosscutting, or trimming, station 18; a series of lugged conveyor segments 20*a*, 20*b*, 20*c*, 20*d* (including, for example, endless linked chains supported on friction-inhibiting races such as race R shown fragmentarily in FIG. 3), which will be referred to collectively as a lugged conveyor 20; and end-evening roll sets 22*a*, 22*b*, 22*c*, all of which may be of conventional design. Raw boards such as a given board B shown in end view travel from upstream to downstream in the direction indicated by the arrow (from left to right in FIGS. 1 and 2).

Lugged loader 14 loads, or successively picks off foremost ones of a sheet of boards for individual placement of each on lugged conveyor segment 20*a*. Those of skill in the art will appreciate the importance of using lugged conveyors in high-speed board handling, especially of untrimmed boards which are difficult to control. An exemplary, high-speed lugged loader is described in U.S. Pat. No. 4,945,976 issued Aug. 7, 1990 and subject to common ownership herewith. It will be appreciated that any suitable means for spacing individual boards along a lugged conveyor may be used.

End-evening roll set 22*a* drives each board against a side rail 23*a* (not shown in FIG. 1 for the sake of clarity, but shown schematically in FIG. 2). This end-evening process ensures that downstream processing, including the board scanning and trimming operations, is performed consistently relative to one or the other of the ends of each board. It will be appreciated that raw boards on lugged conveyor 20*a*, which have not yet been trimmed, may be of various lengths.

Optimizing scanner station 16 typically includes a transverse array of lasers or other light sources and sensors, or photocells, for scanning each board as it passes thereby on lugged conveyor segment 20*a*. A computerized controller within scanning station 16 collects raster scanned point data from the photocells and, by interpolation, produces length, width, thickness and wane information on, i.e. top-plan-view and cross-sectional profiles of, each board. The controller then analyzes a given board B's profile data and, based upon predefined quality, grading and demand criteria, renders a decision as to where the given board B should be crosscut in order to maximize yield. Because the data gathering process is serial, and because the data interpolation and decision-making processes are time-consuming, typically no decision regarding the optimal crosscut of a given scanned board B is rendered until board B has advanced downstream a predetermined distance, e.g. on conveyor segment 20*b* to the location illustrated in FIGS. 1 and 2 and labeled DECISION POINT. So, by the time a scanning operation on given board B indicates that given board B should be cut in two at crosscutting station 18, a predetermined number of upstream boards have already been picked by lugged loader 14 onto conveyor 20.

End-evening roll set 22*b*, like roll set 22*a*, ensures that the scanned boards remain even with respect to a given end as they enter crosscutting station 18 by driving them against a side rail 23*b*. As can be seen better from FIG. 2, crosscutting station 18 includes a transverse array of plural, independently operable, crosscut saws at predetermined lateral spacing that in operation produces cut boards of desired, incremental lengths. For example, such saws might be spaced apart by one or two feet, so that the crosscut operation yields cut boards the lengths of which are multiples of one or two feet. While no board hold-down mechanism is shown in FIGS. 1 and 2, those skilled in the art will appreciate that such may be provided to avoid bucking or kicking of a board while it is being crosscut. Finally, it will be appreciated that more than one of the crosscut saws of the array can be operated at once, thereby to produce multiple crosscuts in a given board located within crosscutting station 18.

It will be appreciated that the cut decision rendered by optimizing scanner 16 may result in more than simply trimming one or more ends of a given board. For example, a board that has a damaged edge only on one end might be cut in two and both halves, or cut pieces, advanced downstream for further processing, e.g. finishing of the board piece having a good edge and ripping of the board piece having the bad edge. In this case and many like it, an empty space on lugged conveyor 20 is needed to accommodate the extra board produced by the crosscut operation It may be seen from FIGS. 1 and 2, and by focusing on DECISION POINT, that, by the time an optimized crosscut decision is rendered by scanner station 16 for a given board B, the given board B has been advanced by lugged conveyor 20 to a position that is a given distance D from lugged loader 14. This distance D, which is illustrated as being approximately equal to the space between five lugs of the lugged conveyor, may be thought of as representing a sequence of two delay periods in the operation of board handling system 12: The first delay period is a positional delay equal to the amount of time it takes for a given board B to travel from lugged loader 14, or the upstream end of lugged conveyor segment 20*a*, to scanning station 16. The second delay period is a decision delay equal to the amount of time it takes for scanning station 16 to process the raster scan data from the photocell array and to render a crosscut decision that will produce an optimal yield from the given board B. The sum of the positional and decisional delays is the period of time for which, as will be seen, apparatus 10 must compensate when the decision of scanner station 16 is to produce cut-in-two board pieces for further downstream processing.

Temporary board storage apparatus 10 of the invention is disposed downstream from crosscutting station 18 In accordance with the preferred embodiment of the invention, apparatus 10 includes rotary board storage means, or a cylindrical circulating wheel, 24 having a central, elongate shaft 26 that is rotatable synchronously and preferably in common with conventional drive means (not shown) for advancing lugged conveyor 20. As may better be seen from FIG. 2, wheel 24 includes plural, laterally spaced circular disks 28 each rigidly mounting plural, radially extending lugs 30 having free distal ends. Adjacent each disk and lugs structure is fixed guide means, or a plurality of guide rails, 32, which extends arcuately substantially around the periphery of the distal ends of lugs 30 to form an opening 32*a* adjacent a run of lugged conveyor segment 20*d*. Guide rails 32 are rigidly mounted on transversely oriented upstream and downstream support beams 34.

By the alignment of corresponding lugs 30 of each disk-and-lugs structure (refer to FIG. 1), plural arcuately spaced bins 36 opening radially outwardly are formed in wheel 24, each bin 36 being dimensioned marginally to temporarily store cut-in-two board pieces having a predetermined nominal thickness and width, which board pieces are produced by crosscutting station 18. When shaft 26 is rotated in common with the advancement of lugged conveyor 20, bins 36 of wheel 24 rotate in the direction of the arrow (counterclockwise in FIG. 1). Thus, plural guide rails 32 may be thought of as providing apparatus 10 with fixed guide means extending arcuately around rotary board storage means 24 for effectively closing each of the plurality of bins 36 of the storage means, except for a given one of the bins momentarily occupying a position adjacent lugged conveyor 20. Each bin 36 formed by the cooperation of plural disc-and-lugs structures and corresponding guide rails can be seen to be capable of temporarily storing a cut-in-two board piece produced by crosscutting station 18. Preferably, the number of bins 36 is equal to the predetermined number of upstream boards which have already been picked onto conveyor 20 between the time a given board is picked onto conveyor 20 and the time scanning station 16 renders a cut-in-two decision ("DECISION POINT"). Those with skill in the art will appreciate that rotary board storage means 24 and fixed guide means 32 may take alternative forms.

Figure 3:
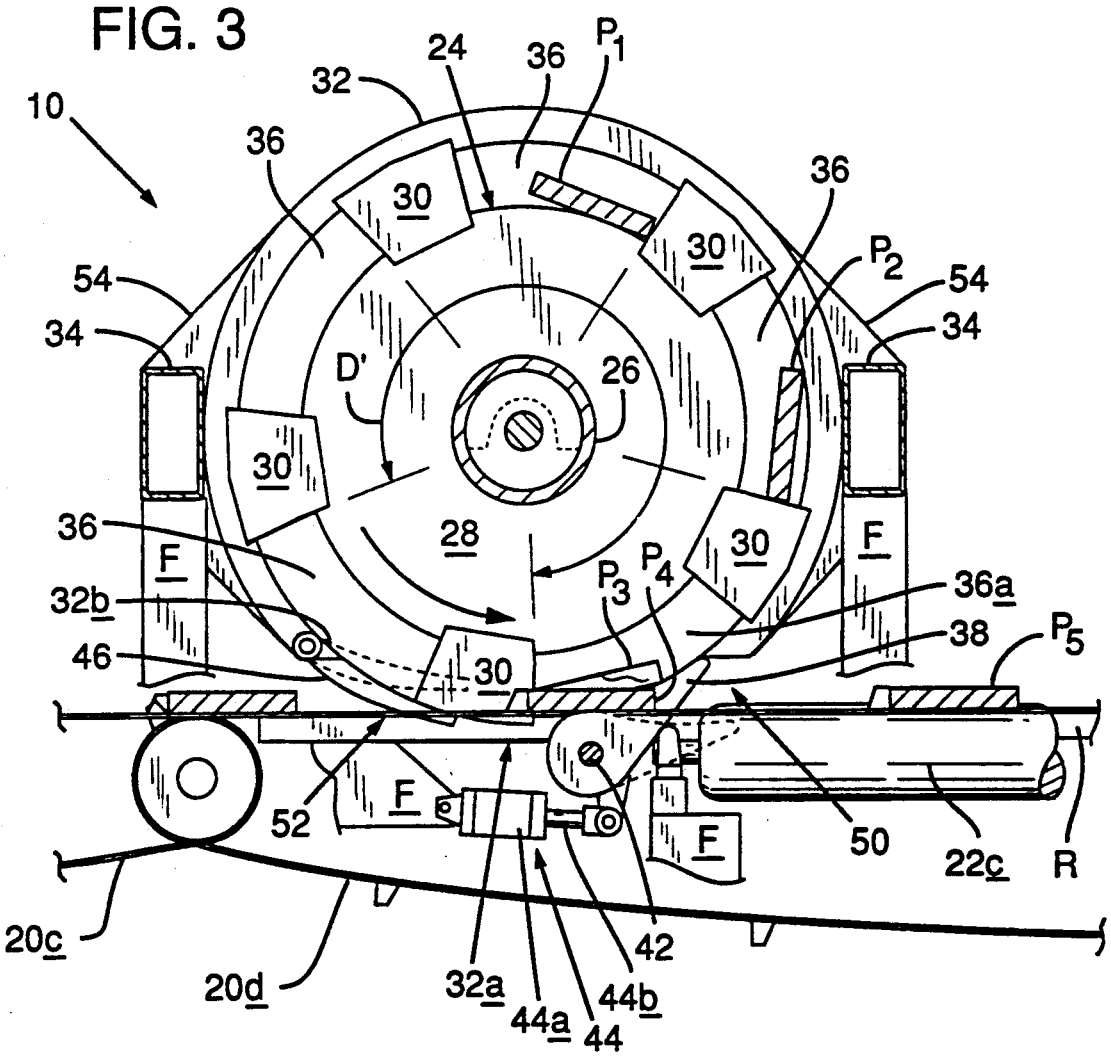
FIG. 3 is an enlarged, detailed front elevation of the invention made in accordance with its preferred embodiment

Apparatus 10 includes selectively operable pick means 38 for urging one of two side-by-side, cut-in-two board pieces from a first lugged location of conveyor 20 into the open one of bins 36, which as may be seen best from FIG. 3 is positioned adjacent conveyor 20 with its opening generally tangential with, or in the plane of, segment 20*d* thereof. In accordance with the preferred embodiment of the invention, pick means 38 takes the form of a plurality of laterally spaced pivotal gates 38 (refer to FIG. 1), each corresponding with a discs-and-lug structure of rotary board storage means 24. Each gate 38 is selectively operable to divert a board from lugged conveyor segment 20*d* into the bottom bin 36*a*, which is open due to its present, rotation-produced proximity to aligned openings 32*a* in guide rails 32 Gates 38 in their normal position (indicated by a dashed line in FIG. 1) are beneath the plane of lugged conveyor 20, and permit a board to be advanced downstream past apparatus 10 without impediment. Another set of end-evening rolls 22*c* drives trimmed and selectively circulated boards on conveyor segment 20*d* against a side rail 23*c* (refer to FIG. 2).

Rotary board storage means 24 may be seen to provide for the automatic placement of the picked one of two side-by-side, cut-in-two boards back onto conveyor 20 at a second lugged location upstream from the first lugged location from which it was picked by pick means 38. By providing five bins 36 in circulating wheel 24 and by rotating circulating wheel 24 at a predetermined speed based upon the linear speed of conveyor 20, the second lugged location at which such one of two cut-in-two board pieces is placed is the empty space immediately following the lugged location of the last of the successive boards already picked onto conveyor 20. Even if each of five successive boards on conveyor 20 is cut in two, the provision in circulating wheel 24 of five bins permits the circulated board pieces to be placed in successively empty spaces upstream on conveyor 20, each empty space representing decisional control by scanning station 16, as communicated to lugged loader 14, to skip the next board in a sheet of boards.

Those of skill in the art will appreciate that the number of bins provided in circulating wheel 24 may vary, depending upon the positional and decisional delays imposed by a given board handling system in which apparatus 10 might be installed. Those of skill also will appreciate that the number and positioning of the disk-and-lugs structures and their associated guide rails and gates, may be varied For example, fewer than the nine shown in FIG. 2 might be provided, eliminating some from a region on the remote end of shaft 26 (nearer the top of FIG. 2) so that in all cases the proximate one (nearer the bottom of FIG. 2) of a pair of cut-produced board pieces is circulated. Such a modification, while perhaps reducing the versatility of apparatus 10, would greatly simplify the construction of circulating wheel 24 and thus reduce the cost of apparatus 10.

FIG. 1 shows an important advantage of the invention by which apparatus 10 straightforwardly and cost effectively can be retrofitted onto existing systems. While it might have a longitudinal extent (above conveyor segment 20*d*) of approximately six feet, nevertheless apparatus 10 typically takes up no floor space, because of its tangential interface with existing lugged conveyors that form a part of such systems and that typically extend already at least six feet longitudinally downstream of a crosscutting station.

Figure 4:
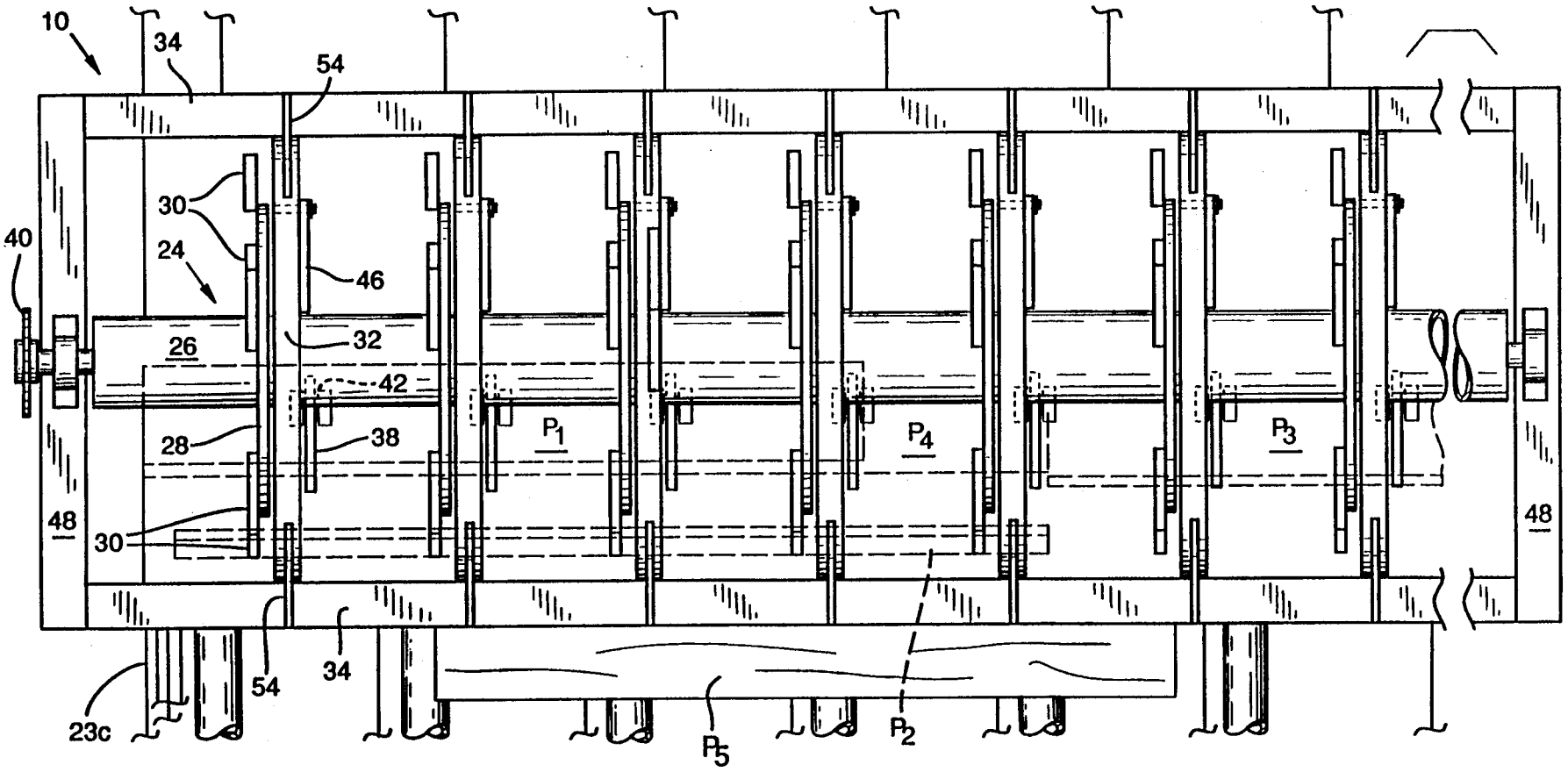
FIG. 4 is a top plan view of the invention corresponding to FIG. 3.

Turning collectively to FIGS. 3 and 4, apparatus 10 in its preferred embodiment will be described in some detail. Circulating wheel 24 is driven in common with conveyor 20, e.g. via a linked chain (not shown) engaging a sprocket 40 (refer to FIG. 4) operatively connected for rotation with shaft 26. The part of apparatus 10 which descends below the plane of conveyor 20 includes plural gates 38, which are preferably bearing mounted for reciprocating pivotal movement on shafts 42 by cylinder assemblies 44. Each cylinder assembly 44 includes an air cylinder 44*a* selectively operable to extend/retract a push rod 44*b* operatively coupled with a depending pivot arm 38*a* of a corresponding gate 38. Each cylinder assembly 44 in turn is pivotally mounted as shown to a frame member F of system 12.

A pivotal slide member 46 is provided adjacent an upstream terminus 32*b* of each guide rail 32. In a first position shown in solid lines in FIG. 3, slide member 46 would guide a board contained within one of bins 36 smoothly onto the run of conveyor segment 20*d* directly underneath apparatus 10. In a second position shown in dashed lines in FIG. 3, slide member 46 would glide smoothly over the upper surface of a board advanced by conveyor segment 20*d*. It will be understood that slide member 46 typically would assume the first position of its own weight or under the weight of a circulating board. Thus, slide member 46 would be in this first position as the empty space on conveyor 20*d* approaches circulating wheel 24, permitting a circulated board smoothly, flatly and stably to slide down member 46 and onto conveyor segment 20*d* just ahead of the lug position that represents the EMPTY SPACE created by lugged loader 14 under the control of scanning station 16. Otherwise, slide member 46 will be successively pivoted into its second position by a succession of boards passing on conveyor segment 20*d*.

A plurality of planar, generally trapezoid-shaped lugs 30 can be seen to be rigidly mounted, e.g. by welding, along the periphery of a corresponding disk 28. Bins 36, the sizes of which generally are defined by the diameters of disks 28 and the arcuate extents of lugs 30, preferably are themselves dimensioned with an arcuate extent that is nominally, or marginally, capable of accommodating a predetermined width of boards. By their arcuate extent in accordance with the preferred embodiment of the invention, lugs 30 thus confine movement within bins 36 of board pieces stored therein as circulating wheel 24 rotates. This minimizes any potential damage to the board pieces as they pivot, rock and slide within bins 36. The arcuate extents of lugs 30 also serve to 'shadow' the position of a lug set on conveyor 20, thereby reducing the possibility of jamming which might occur due to speed variations or dimensional tolerances.

Each disk-and-lugs structure, i.e disk 28 mounting plural, arcuately spaced, radially extending lugs 30, may be thought of as a turning 'wheel' of which disk 28 is the 'hub' and lugs 30 are the 'spokes'. Each turning wheel may be seen to be mounted in laterally spaced relation along elongate rotary shaft 26, the axis of which is oriented transversely to lugged conveyor 20. From FIG. 3 it may be seen that each one of lugs 30 of each turning wheel is aligned with a corresponding one of the lugs of each of the other turning wheels. From FIG. 4 it can be seen that plural guide rails 32 preferably are one-to-one with the turning wheels, and are positioned in laterally spaced relation with one another in positions along shaft 26 that correspond generally with the positions of the turning wheels.

From FIG. 3 it may be seen that the arcuate extent D' of each guide rail 32 is approximately equal to the distance D (refer to FIG. 1) between the first and second lugged locations on conveyor 20. This dimensioning of the semi-circumference of guide means 32 permits circulating wheel 24 to be rotated continuously at a constant speed that is synchronized with the continuous, fixed-speed advancement of conveyor 20. The reliable operation of apparatus 10 is thus enhanced by the fact that a common drive is provided between apparatus 10 and system 12 with which it is used, and by the fact that in normal operation there are no starting and stopping of either conveyor 20 or circulating wheel 24. Guide rails 32 preferably are made of square tubular steel rigidly mounted, e.g. by welding, to cross beams 34. Shaft 26 is suitably journal bearing mounted for rotation to a pair of laterally spaced frame members 48 rigidly connecting cross members 34 to the framework of system 12.

Referring again briefly to FIGS. 1 and 2 and focusing on lugged conveyor segment 20*a*, an EMPTY SPACE has been created in the farthest upstream lug position. This EMPTY SPACE was created by scanning station 16 signalling lugged loader 14 not to pick the next board from the board sheet, but instead to hold off the next board, e.g. by actuating a stop arm 14*a*, thereby allowing a single lug set to pass by unallocated. Because the EMPTY SPACE, as illustrated, is five lug positions upstream from DECISION POINT, five bins are provided, as shown in FIGS. 1 and 3, in circulating wheel 24. When the greatest arcuate distance D' between pairs of lugs 30 of wheel 24 is approximately equal to the distance D between the EMPTY SPACE and the DECISION POINT, and when the preferably constant angular velocity of wheel 24 is approximately equal to the preferably constant linear velocity of conveyor 20, a cut-in-two board diverted into, temporarily stored in and released from circulating wheel 24 after one rotation thereof will occupy the EMPTY SPACE on conveyor 20 (which will have been advanced downstream of the position shown in FIG. 1).

Referring still to FIGS. 1 and 2, the invention in its preferred embodiment is described in a slightly different way. Rotary board pick/store/place apparatus 10 and board handling system 12 together represent a substantially improved board scanning/crosscutting system. The improved system may be seen from FIGS. 1 and 2 to include lugged loader 14, or board pick means for normally picking successive boards one at a time from a sheet of boards and advancing the picked boards along a driven conveyor in predefined spaced relationship with one another; scanning station 16, or board scanning means for profiling successive picked boards one at a time as each board is advanced along the conveyor, for selecting one or more crosscutting locations for the board in accordance with predefined criteria and producing one or more cut control signals, and for determining whether the board will be cut in two to produce two cut boards for further downstream processing and, if so, generating one or more deflect control signals; crosscutting station 18, or board crosscutting means responsive to the cut control signals, the crosscutting means including one or more crosscutting saws that are selectively operable to produce one or more crosscuts in successive scanned boards one at a time as each board is advanced along the conveyor; and cut board storage means 10 for temporarily selectively storing one or more cut boards, the storage means including a rotary circulating wheel 24 having plural bins, or compartments, 36 and one or more guide rails 32 extending substantially therearound, thereby effectively sequentially to close all but one of the compartments at a given time, the one compartment that is open being that which is adjacent the conveyor, the storage means further including at least one selectively operable gate 38 operatively coupled wheel 24 and the conveyor that, responsive to the deflect control signals, deflects a selected cut board from the conveyor into the one open compartment, with the circulating wheel being driven synchronously with the conveyor.

In such an improved system, circulating wheel 24 cooperates with guide rails 32 to circulate the selected board piece within the one compartment in such manner that the board piece is carried within the one compartment while it is closed by guide rails 32 in such a manner that the board piece traverses a substantially complete rotation of circulating wheel 24 and then exits the compartment while it is open so that the board piece is deposited back onto the conveyor in the EMPTY SPACE provided by board pick means 14 and by now advanced to a position directly beneath the circulating wheel.

FIG. 1 shows the DEFLECT CONTROL signals' path as a broad, solid, directed line from board scanning means 16 to cut board storage means 10. FIG. 1 also shows a SPACE CONTROL signal path, indicated by a solid, directed line from board scanning means 16 to board pick means 14. The illustrated SPACE CONTROL signal is generated by board scanning means 16, in accordance with the preferred embodiment of the invention, and board pick means 14 is responsive thereto selectively not to pick the next successive board from the sheet of boards, but instead to leave an EMPTY SPACE along the conveyor where a picked board normally would be. Those with skill in the art will appreciate the SPACE CONTROL signal is generated by board scanning means 16 only if it is determined that a given board B will be cut in two to produce two cut boards, or board pieces, as this is the condition which requires that board pick means 14 leave a space to be allocated to one of the two board pieces produced by board crosscutting means 18 responsive to the CUT CONTROL signals indicated in FIG. 1 by a broad, solid, directed line from board scanning means 16 to board crosscutting means 18.

In accordance with the preferred embodiment of such an improved system, circulating wheel 24 includes plural turning wheels rigidly mounted to a common rotatable elongate shaft, e.g. shaft 26, in spaced relationship therealong, the axis of shaft 26 being oriented transversely to conveyor 20. Each of the turning wheels includes plural spaced lugs that extend radially relative to shaft 26 with corresponding lugs of each of the turning wheels being aligned with one another to provide for the generally planar support of a selected cut board, wherein arcuately adjacent groups of transversely aligned lugs define each of the compartments. Plural gates 38 and guide rails 32 are spaced to correspond generally with the turning wheels and at least a selected one of the gates is activated in response to the DEFLECT CONTROL signals produced by board scanning means 16.

Viewed in yet another way, the invention may be appreciated as representing a significant improvement to board scanning/crosscutting systems such as system 12. System 12 may be seen to include a lugged loader, or a selectively controllable board pick station, 14 for picking individual boards from a sheet of boards and advancing the individual boards downstream on a lugged conveyor such as conveyor 20; a board scanning station 16 downstream from pick station 14 capable of profiling individual boards on conveyor 20 and determining a location for a crosscut in accordance with predetermined criteria, e.g. desired board cut length, freedom from defects, etc.; and a board crosscutting station 18 having at least one crosscut selectively actuable in response to such a crosscut location determination made by board scanning station 16 to produce a crosscut in a board. In such a system, the downstream position of scanning station 16 relative to the position of pick station 14 imposes a positional delay based upon the speed of lugged conveyor 20, and the determining step imposes a decisional delay, with such delays resulting in the picking of at least one successive board from the sheet of boards onto lugged conveyor 20 before such a crosscut decision has been rendered on a board immediately downstream from such one picked board. Those of skill will appreciate that even such a short delay, which results in the picking of a single board upstream from the given board B, necessitates accommodating an extra board piece that might be produced by cutting given board B in two pieces for in-line downstream processing.

The improvement to such a system, in accordance with the apparatus of the invention in its preferred embodiment, may be described as including a rotary board pick/store/place apparatus 10 disposed downstream from crosscutting station 18, apparatus 10 being capable of selectively picking at least one cut board and storing each of such picked cut boards for an amount of time approximately equal to the sum of such positional delay and such decisional delay. Apparatus 10 in accordance with the preferred embodiment includes a predefined number of bins, which number may be as small as one, for circulating boards carried therein. Such a predefined number of bins will be understood by those of skill in the art to be greater than or approximately equal to the product of the maximum linear speed of the conveyor and such amount of time. As described above, apparatus 10 is capable of placing each one of such selected stored boards back onto lugged conveyor 20 at a predetermined location upstream of the location from which such selected stored board was picked.

Preferably the apparatus embodying the improvement to such a system includes a generally cylindrical circulating wheel 24 having plural lugs 30 extending radially from central shaft 26 rotated on its central axis by drive means, with lugs 30 defining the arcuate extents of bins 36. The central axis of elongate shaft 26 is oriented preferably transversely across lugged conveyor 20. Apparatus 10 preferably further includes at least a pair of gates 38 selectively operable in response to a divert control signal produced by board scanning station 16 to divert a selected cut board, or board piece, from lugged conveyor 20 into one of bins 36 for temporary storage therein. Thus, apparatus 10 may be thought of as providing for the first-in, first-out (FIFO) storage of at least one board piece, as it can readily be seen from FIG. 1 or 3 that circulating wheel 24 circularly advances board pieces, such as pieces $P_1$, $P_2$, $P_3$ shown in solid lines in FIG. 3 and shown, for the sake of clarity, in phantom (dashed) lines in FIG. 4, diverted thereinto (in a counterclockwise direction, as illustrated) and then places them back on lugged conveyor 20 in the same order that they were diverted therefrom. Such storage is, of course, selective, as board pieces not diverted into circulating wheel 24, e.g. pieces $P_4$, $P_5$ continue downstream, unimpeded thereby, on lugged conveyor 20.

Those of skill in the art will appreciate that a controller within optimizing board scanning station 16 straightforwardly may be programmed to produce properly sequenced control signals to lugged loader 14, board crosscutting station 18 and plural gates 38 of apparatus 10. For example, at DECISION POINT (refer to FIG. 1), scanning station 16 would produce a SKIP CONTROL signal to lugged loader 14, thereby preventing the picking of the next-in-line board from the sheet of boards. At a predetermined interval of time later, based upon the speed of lugged conveyor 20 and the distance between scanning station 16 and crosscutting station 18, plural CUT CONTROL signals would be produced by scanning station 16 to operate the plural crosscut saws of crosscutting station 18 in synchronism with the arrival of the board for which the CUT CONTROL signals were produced. After yet another interval of time based upon the speed of lugged conveyor 20 and the distance between crosscut station 18 and plural gates 38, plural DIVERT CONTROL signals would be produced by scanning station 18 to operate one or more of plural gates 38 in synchronism with the arrival of the cut board piece on a run of lugged conveyor segment **20*d* directly thereabove. Such timing and sequencing of the control signals produced by the controller within scanning station 16 are seen to be dependent upon operational specifications of the board handling system with which apparatus 10** is used.

The preferred method of the invention now can be understood in terms of the preferred embodiment of the apparatus of the invention described above. The preferred to-be-cut-in-two board-handling method includes the steps of (1) normally positioning each one of a succession of boards in one of a succession of allocable spaces along a continuously driven conveyor, e.g. lugged conveyor 20; (2) scanning each one of such succession of boards on the conveyor, e.g. via optimizing scanning station 16, to determine the suitability of each board to be cut in two pieces each suitable for further downstream processing and, if a given board at a given location, e.g. board B at a location downstream a distance D from lugged loader 14, is suitable, then deallocating, or skipping, a space along the conveyor, e.g. by controlling lugged loader 14 not to pick but instead to skip the next board in succession, to produce an empty space upstream from the given location; (3) cutting the given board in two pieces, e.g. via crosscutting station (4) circulating either one of the cut board pieces for a predetermined period of time, e.g. by selectively operating gates 38 to deflect a board piece into circulating wheel 24 and by rotating circulating wheel 24 carrying such one board piece within guard rails 32 in synchronism with lugged conveyor 20; and (5) placing the circulated board piece onto conveyor 20 in the empty space, e.g. by permitting the circulated board piece smoothly to slide down slide member 46 onto conveyor segment **20*d***.

It will be understood that the positioning and scanning steps impose sequential, positional and decisional delays of an amount that can be predetermined for a particular system such as system 12. It will also be appreciated that, in order to compensate for such delays, the circulating step preferably is done for a like period of time. Thus, by continuously advancing the empty space along conveyor 20 toward apparatus 10 and by continuously rotating circulating wheel 24, which carries at least one such cut-produced board piece, such one board piece is placed back on conveyor 20 precisely in synchronism with the arrival, directly beneath apparatus 10 and tangent to circulating wheel 24, of the lug set providing an empty space therefor.

Preferably, the conditional skipping part of the scanning step is performed in such manner that the empty space produced thereby is a predetermined number of allocable spaces upstream from the given location. Thus, the circulating step involves permitting the same predetermined number of allocable spaces to pass downstream with advancement of the conveyor. When conveyor 20 and circulating wheel 24 are driven synchronously with one another, and preferably at constant speeds such that the angular velocity of circulating wheel 24 and the linear velocity of conveyor 20 are equal, circulated board pieces reliably and accurately assume a position on the conveyor immediately ahead (downstream) of the proper set of lugs. Such continuous rotation of circulating wheel 24 eliminates the need for starting and stopping the circulating wheel and undesirable acceleration and deceleration of a cut board piece therein that would result therefrom. It also avoids the need for a clutch or the like. Smooth, continuous flow of boards, including extra board pieces, at speeds in excess of one hundred fifty boards per minute (>150 bpm) is achievable.

Preferably the circulating step is performed by deflecting a selected one of the cut board pieces from the conveyor onto the circulating wheel at an infeed zone 50 (refer to FIG. 3) of the circulating wheel, where infeed zone 50 is defined generally as that area of aligned openings 32*a* nearer gates 38. Also preferably, the placing step is performed by diverting the selected cut board piece which was circulated from the circulating wheel at an outfeed zone 52 (refer to FIG. 3) of the circulating wheel onto the conveyor where outfeed zone 52 is defined generally as that area of aligned openings 32*a* nearer slide members 46. Incidentally, in its preferred embodiment, apparatus 10 includes braces 52 (refer to FIGS. 3 and 4) extending between frame-mounted cross members 34 and guide rails 32, above and below the former.

Modifications to the preferred embodiment of the invention described herein are deemed to be within the spirit of the invention. For example, those of skill in the art will appreciate that the number of bins provided in circulating wheel 24 may be varied, that an external system controller may provide the necessary control signals to control not only the lugged loader, the crosscutting station and the deflect gates which form a part of the board pick/store/place apparatus, but also the scanning station. It may be seen that, so long as the positional and decisional delays within a system such as system 12 are greater than the time required to advance a lug set of the conveyor by one lug position—even if one or the other of the delays is zero—the apparatus of the invention advantageously permits the system to handle cut-in-two boards suitable for further downstream processing, in line and without diverting them from mainstream board processing. Moreover, the apparatus of the invention offers the added benefit of its retrofitability into existing installations because of its negligible foot print.

Accordingly, while a preferred embodiment of the apparatus of the invention, as well as a preferred method thereof, have been described herein, it is appreciated that numerous modifications are possible that come within the scope of the invention.

It is claimed and desired to secure by letters patent:

1. An improved method for handling a to-be-cut-in-two board comprising:

normally positioning each one of a succession of boards to one of a succession of allocable spaces along a continuously driven conveyor;

scanning each one of such succession of boards on such conveyor to determine the suitability of each board to be cut in two pieces each being suitable for further downstream processing and if a given board at a given location is suitable then skipping a space along such conveyor to produce an empty space upstream from such given location;

cutting such given board in two pieces;

circulating one of such cut board pieces for a predetermined period of time; and placing such circulated board piece onto such conveyor in said empty space.

2. The method of claim wherein said skipping is performed in such manner that such empty space is upstream from such given location by a predetermined number of allocable spaces, and wherein said circulating is performed in such manner that said predetermined number of allocable spaces are permitted to pass downstream.

3. The method of claim 1, wherein said circulating is performed by rotating a circulating wheel carrying such one of such cut board pieces.

4. The method of claim 3, wherein said rotating is continuous.

5. The method of claim 3, wherein said circulating is performed by diverting such one of such cut board pieces from such conveyor to said circulating wheel at an infeed zone thereof and wherein said placing is performed by diverting such one of such cut board pieces from said circulating wheel at an outfeed zone thereof onto such conveyor.

6. In a board scanning/crosscutting system comprising a selectively controllable board pick station for picking individual boards from a sheet of boards and advancing the individual boards downstream on a lugged conveyor, a board scanning station downstream from the pick station capable of profiling individual boards on the conveyor and determining a location for a crosscut in accordance with predetermined criteria, in which such downstream position of the scanning station relative to the position of the pick station imposes a positional delay based upon the speed of the conveyor and in which such determining step imposes a decisional delay, and a board crosscutting station having at least one crosscut saw selectively actuable in response to such a determination made by the board scanning station to produce a crosscut in a board, the improvement comprising:

rotary board pick/store/place apparatus disposed downstream from said crosscutting station, said pick/store/place apparatus being capable of selectively picking plural cut boards and storing each of such picked cut boards for an amount of time approximately equal to the sum of such positional delay and such decisional delay, said rotary board pick/store/place apparatus including a predefined number of bins for circulating boards carried therein wherein the predefined number is greater than or approximately equal to the product of the maximum linear speed of the conveyor and such amount of time, said rotary board pick/store/place apparatus being capable of placing each one of such selected stored boards onto the conveyor at a predetermined location upstream of the location from which such selected stored board was picked.

7. The improvement of claim 6 wherein said apparatus includes a generally cylindrical wheel having plural lugs extending radially from a central shaft rotated on a central axis by drive means, said lugs defining the arcuate extents of said bins, said axis of said shaft being oriented generally transversely across the conveyor, said apparatus further including a pair of gates selectively operable to divert a selected cut board from the conveyor into one of said bins for temporary storage therein.

8. For use with lumber handling systems having a board pick station, a lugged conveyor, a board scanning station and a board crosscutting station wherein, by the time a scanning operation on a given board indicates that the given board should be cut in two at the crosscutting station, a predetermined number of upstream boards have already been picked onto the conveyor, temporary board storage apparatus comprising:

rotary board storage means disposed downstream from a board crosscutting station, said storage means including a plurality of arcuately spaced bins opening radially outwardly;

fixed guide means extending arcuately around said storage means for effectively closing each of said plurality of bins of said storage means except for a given one of said bins occupying a position adjacent a lugged conveyor, whereby each bin is capable of temporarily storing a cut-in-two board produced by the board crosscutting station, wherein the number of said bins equals a predetermined number of upstream boards which have already been picked onto the conveyor;

selectively operable pick means for urging one of two side-by-side cut-in-two board pieces from a first lugged location of the conveyor into an open one of said bins positioned adjacent the conveyor;

said storage means being rotated synchronously with advancement of the conveyor such that the angular velocity of rotation of said storage means approximately equals the linear velocity of the conveyor, said storage means automatically placing such one of two side-by-side cut-in-two boards back onto the conveyor at a second lugged location upstream from such first lugged location, with such second lugged location immediately following a lugged location of a last one of said successive boards already picked onto the conveyor.

9. The apparatus of claim 8, wherein each of said plural bins is dimensioned with an arcuate extent nominally to accommodate a predetermined width of such board pieces thereby to confine movement therein of such stored one of two board pieces as said storage means rotates.

10. The apparatus of claim 9, wherein said plural bins are formed by a plurality of wheels rigidly mounted in spaced relation along an elongate rotary shaft the axis of which is oriented transversely to such lugged conveyor, each of said wheels including a plurality of lugs each of which is aligned with a corresponding one of said plurality of lugs of each of the others of said wheels, and wherein said guide means includes a plurality of guide rails in laterally spaced relation with one another in positions along said shaft corresponding with said plural wheels.

11. The apparatus of claim 8, wherein the arcuate extent of said guide means approximately equals the distance between such first and second lugged locations of the lugged conveyor.

12. An improved board scanning/crosscutting system comprising:

board pick means for normally picking successive boards one at a time from a sheet of boards and advancing the picked boards along a driven conveyor in predefined spaced relationship with one another, said board pick means being responsive to a space control signal selectively not to pick but instead to leave a space along said conveyor where a picked board normally would be;

board scanning means for profiling successive picked boards one at a time as each board is advanced along the conveyer, for selecting one or more crosscutting locations for the board in accordance with predefined criteria and producing one or more cut control signals, and for determining whether the board will be cut in two to produce two cut boards for further downstream processing and if so generating the space control signal and a deflect control signal;

board crosscutting means responsive to said cut control signals, said crosscutting means including one or more crosscutting saws that are selectively operable to produce one or more crosscuts in successive scanned boards one at a time as each board is advanced along the conveyor; and cut board storage means for temporarily selectively storing one or more cut boards, said storage means including a rotary circulating wheel having plural compartments and one or more guide rails extending substantially therearound thereby effectively sequentially to close all but one of the compartments at a given time, said one compartment being adjacent said conveyor, said storage means further including at least one selectively operable gate operatively coupled with said circulating wheel and said conveyor that responsive to a deflect control signal deflects a selected cut board from said conveyor into said one compartment, said circulating wheel being driven synchronously with said conveyor and cooperating with said guide rails to circulate such selected cut board carried within said one compartment in such manner that such selected cut board traverses a substantially complete rotation of said circulating wheel and is deposited back onto said conveyor in the space provided by said board pick means.

13. The system of claim 12, wherein said circulating wheel includes plural turning wheels rigidly mounted to a common rotatable elongate shaft in spaced relationship therealong, the axis of said shaft being oriented transversely to said conveyor, each of said turning wheels including plural spaced lugs that extend radially relative to said shaft with corresponding lugs of each of said turning wheels being aligned with one another to provide for the generally planar support of such a selected cut board, wherein each adjacent pair of lugs define one of said compartments, wherein said gates and said guide rails are spaced to correspond generally with said turning wheels and wherein at least a selected one of said gates is activated in response to said deflect control signal.

* * * * *